US010934971B2

(12) United States Patent
Marko

(10) Patent No.: US 10,934,971 B2
(45) Date of Patent: Mar. 2, 2021

(54) ISOCHORIC PISTON-CYLINDER HEAT PUMP

(71) Applicant: Matthew David Marko, Seaside Heights, NJ (US)

(72) Inventor: Matthew David Marko, Seaside Heights, NJ (US)

(73) Assignee: Matthew David Marko, Seaside Heights, NJ (US)

( * ) Notice: Subject to any disclaimer, the term of this patent is extended or adjusted under 35 U.S.C. 154(b) by 26 days.

(21) Appl. No.: 16/037,707

(22) Filed: Jul. 17, 2018

(65) Prior Publication Data

US 2020/0025127 A1 Jan. 23, 2020

(51) Int. Cl.
*F02G 1/055* (2006.01)

(52) U.S. Cl.
CPC ..... *F02G 1/055* (2013.01)

(58) Field of Classification Search
CPC ... F02G 1/043; F02G 2243/30; F02G 2250/00
See application file for complete search history.

(56) References Cited

U.S. PATENT DOCUMENTS 3,591,958 A * 7/1971 Nebgen ..... F02B 75/02 60/599
4,341,070 A * 7/1982 Clarke ..... F02B 75/02 60/39.511
6,272,855 B1 * 8/2001 Leonardi ..... F01B 17/022 60/513
7,685,817 B2 * 3/2010 Carrott ..... F02G 1/043 60/512
2007/0227138 A1 * 10/2007 Carrott ..... F02G 1/055 60/520
2009/0000294 A1 * 1/2009 Misselhorn ..... F02G 1/0435 60/517
2017/0328603 A1 * 11/2017 Barclay ..... F25J 1/0225

* cited by examiner

*Primary Examiner* — Shafiq Mian

(57) ABSTRACT

An internally reversible thermodynamic heat pump cycle of isentropic expansion, isochoric heating, and isothermal compression, and using a constant-temperature heat source and sink. This heat pump cycle has a Coefficient of Performance that exceeds the Carnot maximum Coefficient of Performance for its maximum temperature range; this heat pump does not violate the second law of thermodynamics.

9 Claims, 12 Drawing Sheets

Figure 1: Pressure-Volume diagram for an isothermal heat pump, for $\phi = 5$ and $k = 1.4$.

Figure 2: Temperature-entropy diagram for the isothermal heat pump, for $\phi = 5$ and $k = 1.4$. The unit value of $S$ in this figure represents the net specific entropy change $S_{23}^{in}$ (J/kg·K) defined in equation 38.

Figure 3: Pressure-Volume diagram for a high-temperature heat pump, for $\phi = 5$ and $k = 1.4$.

Figure 4: Temperature-entropy diagram for the high-temperature heat pump, for $\phi = 5$ and $k = 1.4$. The unit value of $S$ in this figure represents the net specific entropy change $S_{23}^{in}$ (J/kg·K) defined in equation 38.

Figure 5: Pressure-Volume diagram for a moderate-temperature heat pump, for $\phi = 5$ and $k = 1.4$.

Figure 6: Temperature-entropy diagram for the moderate-temperature heat pump, for $\phi = 5$ and $k = 1.4$. The unit value of $S$ in this figure represents the net specific entropy change $S_{23}^{in}$ (J/kg·K) defined in equation 38.

Figure 7: Normalized Pressure Data for the isothermal heat pump cycle example.

Figure 8: Normalized Temperature Data for the isothermal heat pump cycle example.

ISOCHORIC PISTON-CYLINDER HEAT PUMP

BACKGROUND OF THE INVENTION

From well before recorded human history, man has quested for different sources of energy for survival and comfort. Today, the need for useful energy plays a role in almost all aspects of our society. Refrigeration and heat pump systems are used in countless applications where heating and cooling are sought. When designing an engine, heat pump, or other thermodynamic cycle, one can never get around the laws of thermodynamics. Prevalent is the first law, which stipulates the conservation of energy; no energy can be created or destroyed, but must come from a source. The second law is a result of the fact that heat can only flow from hot to cold, never cold to hot, and as a result, the net entropy in the universe can never decrease for a thermodynamic process. These two natural limitations must be recognized in the design of a thermodynamic machine to manipulate different sources of heat and mechanical energy.

BRIEF SUMMARY OF THE INVENTION

The inventor proposes a mechanical heat pump, based on a novel, closed loop, internally reversible thermodynamic cycle, where an ideal gas is in a sealed cylinder with a piston that can both compress the gas, as well as recover energy from the gas expansion. This cycle utilizes a supply of constant-temperature ambient air, which will both allow for a source of heat input at the cold stage, as well as a heat sink from the hot stage. The cycle starts off as a high-pressure, ambient-temperature gas that undergoes isentropic expansion, resulting in a recovery of useful mechanical work to the crankshaft and motor/regenerative brake as the piston moves from Top Dead Center (TDC) to Bottom Dead Center (BDC). The piston is then fixed at BDC, and the gas is allowed to heat back up to the ambient temperature at a constant volume (isochoric). This heating will raise the pressure of the gas, but to a pressure less than the initial pressure at TDC. The last and final stage is for the piston, powered by the crankshaft and electric motor to compress the medium pressure gas back to the original pressure and TDC volume; this compression is slow enough that the process is effectively isothermal at the ambient-temperature.

DETAILED DESCRIPTION OF THE INVENTION

In order to do an analysis of a thermodynamic cycle, several relevant thermodynamic equations will be used. These equations listed represent well-established thermodynamic principles, based on both statistical mechanics and hundreds of years of experimental observation. This analysis will assume a perfect, ideal gas, that follows the ideal gas law $$Pv=RT, \tag{1}$$

where P (Pa) is the pressure, v ($m^3$/kg) is the specific volume, T (K) is the absolute temperature, and R (J/kg·K) is the specific gas constant, where $$R = \frac{R_u}{M_m}, \tag{2}$$

where $R_u$ is the universal gas constant (8.314 J/M·K), and $M_m$ (kg/M) is the molar mass.

Mayer's relation relates the specific gas constant to the specific heats for a thermally perfect ideal gas, $$\begin{aligned} R &= C_P - C_V, \\ &= C_P - \frac{C_P}{k}, \\ &= C_P \cdot \left(1 - \frac{1}{k}\right), \end{aligned} \tag{3}$$

which yields $$R = C_P \cdot \left(\frac{k-1}{k}\right), \tag{4}$$

where $C_P$ (J/kg·K) is the specific heat for a constant pressure (isobaric), $C_V$ (J/kg·K) is the specific heat for a constant volume (isochoric), and k is the dimensionless specific heat ratio $$k = \frac{C_P}{C_V}. \tag{5}$$

The specific heat ratio k is determined (ideally) by $$k = 1 + \frac{2}{f}, \tag{6}$$

where f is the number of degrees of freedom of the molecule. A monatomic gas such as helium has 3 degrees of freedom (k=5/3), and a diatomic gas such as air has 5 degrees of freedom (k=7/5).

Taking equation 4, the ideal gas law (equation 1) can be rewritten as $$P \cdot v = \left(\frac{k-1}{k}\right) \cdot C_P \cdot T, \tag{7}$$

and the constant pressure specific heat can thus be defined as $$C_P = \frac{P \cdot v}{T} \cdot \left(\frac{k}{k-1}\right). \tag{8}$$

The equations will be derived into relationships of normalized absolute temperature T (K), pressure P (Pa), specific volume v ($m^3$/kg), and specific heat ratios k.

The specific heats can be defined as $$C_V = \left(\frac{\partial u}{\partial T}\right)_V, \tag{9}$$

$$C_P = \left(\frac{\partial h}{\partial T}\right)_P, \tag{10}$$

where u (J/kg) is the specific internal energy, and h (J/kg) is the specific enthalpy, defined as $$\begin{aligned} h &= u + P \cdot v, \\ &= u \cdot k. \end{aligned} \tag{11}$$

It is noted that despite the different heat inputs for a temperature increase at isobaric and isochoric conditions, both equations 9 and 10 are applicable, as enthalpy and internal energy changes from heating are (for a given material) a property dependent on the temperature.

There is a constant relationship of the pressure, specific volume, and the specific heat ratio k, for an ideal gas undergoing isentropic compression or expansion, $$P \cdot v^k = \text{Constant}, \tag{12}$$

and using this constant relationship described in equation 12, along with the ideal gas law (equation 1), relationships for the change in pressure, temperature, and specific volume can be described as a function of the specific heat ratio k, where $$\left(\frac{T_1}{T_2}\right)_{\Delta S=0} = \left(\frac{v_1}{v_2}\right)^{k-1}, \tag{13}$$

$$\left(\frac{T_2}{T_1}\right)_{\Delta S=0} = \left(\frac{P_2}{P_1}\right)^{\frac{k-1}{k}}, \tag{14}$$

$$\left(\frac{P_2}{P_1}\right)_{\Delta S=0} = \left(\frac{v_1}{v_2}\right)^{k}, \tag{15}$$

and these relationships will be used to determine the changes in thermodynamic properties throughout the different steps of the thermodynamic cycles. By definition an isentropic process is entirely reversible and generates no entropy S (J/kg·K), a measurement of the disorder in the universe that is generated from heat transfer, where $$S = \frac{Q}{T}. \tag{16}$$

During an isentropic processes, where no entropy is generated and equation 12 is applicable, the change in internal energy Δu (J/kg) is $$\begin{aligned} \Delta u &= \int_{v_1}^{v_2} P \cdot dv, \\ &= R \cdot \frac{1}{k-1} \cdot (T_2 - T_1), \\ &= C_V \cdot (T_2 - T_1), \\ &= W_{boundary}, \end{aligned} \tag{17}$$

and the change in enthalpy Δh (J/kg) is $$\begin{aligned} \Delta h &= \int_{P_1}^{P_2} v \cdot dP, \\ &= R \cdot \frac{k}{k-1} \cdot (T_2 - T_1), \\ &= C_P \cdot (T_2 - T_1). \\ &= W_{flow}, \end{aligned} \tag{18}$$

For isentropic compression and expansion in a control volume, as is the case of flow through a turbine, the work input and output $W_{flow}$ (J/kg) is proportional to the change in enthalpy (equation 18). For moving boundary work, as is the case of isentropic compression and expansion by a piston in a cylinder, the work input and output $W_{boundary}$ (J/kg) is equal to the change in internal energy (equation 17).

If there is a non-isentropic (subject to heat transfer) thermodynamic process where the rate of heat transfer and mechanical work is slow enough so that the temperature remains constant, where $T_1=T_2$, then the process is considered to be isothermal, and the mechanical work input $W_{\Delta T=0}$ (J/kg) is $$\begin{aligned} W_{\Delta T=0} &= -\int_{v_1}^{v_2} P \cdot dv = \int_{P_1}^{P_2} v \cdot dP, \\ &= R \cdot T \cdot \log\left(\frac{v_1}{v_2}\right) = R \cdot T \cdot \log\left(\frac{P_2}{P_1}\right), \end{aligned} \tag{19}$$

where log is the natural logarithm. As the temperature is constant, the enthalpy h (J/kg) and internal energy u (J/kg) are constant, and therefore the heat energy out is equal to the mechanical work input $W_{\Delta T=0}$ defined in equation 19.

The Coefficient of Performance (COP) of a heat pump can be defined as $$COP_{HP} = \frac{Q_{out}}{W_{net}}, \tag{20}$$

and the refridgerant COP is defined as $$\begin{aligned} COP_R &= \frac{Q_{in}}{W_{net}}, \\ &= COP_{HP} - 1. \end{aligned} \tag{21}$$

If one were to assume that the net work input $W_{net}$ is equal to the difference between the heat energy in and out $$W_{net} = Q_{out} - Q_{in},$$

and the ideal heat pump is one that generates no entropy (equation 16) increase to the universe $$\begin{aligned} \Delta S &= \frac{Q_{out}}{T_H} - \frac{Q_{in}}{T_L}, \\ &= 0, \end{aligned}$$

where $T_L$ (K) is the lowest temperature, and $T_H$ (K) is the maximum temperature, one can find the maximum theoretical COP, also defined as the Carnot COP $$COP_{HP,c} = \left(1 - \frac{T_L}{T_H}\right)^{-1}, \tag{22}$$

$$COP_{R,c} = \left(\frac{T_H}{T_L} - 1\right)^{-1}, \tag{23}$$

The inventor claims a mechanical heat pump that uses a novel thermodynamic cycle, represented as an ideal, lossless cylinder (Part 1) and piston (Part 2), operating under the assumption that there is a constant temperature heat source/sink, to both heat and cool the working gas (Part 3) at various stages of the thermodynamic cycle. This heat source/sink is effectively the outside universe, and is maintained at a constant temperature $T_S$. In addition, a reference pressure $P_M$ will be used through the cycle; this pressure represents the pressure of the gas at temperature $T_S$ when the cylinder is at TDC.

The thermal cycle starts out with the piston at TDC, and the arbitrary specific volume of the gas in this state is defined as $v_T$ ($m^3$/kg). The volume at BDC is simply the volume at TDC multiplied by the dimensionless compression ratio $\phi$, where $$v_{BDC}=\phi\cdot v_T, \tag{24}$$

and $\phi$ inherently is greater than 1. The compression ratio $\phi$ is determined by the length of the crankshaft connecting rod (Part 6), $$\phi = \frac{s}{s-2\cdot l}, \tag{25}$$

where s (m) is the stroke of the cylinder (Part 1), and l (m) is the length of this crankshaft connecting rod (Part 6).

The thermodynamic cycle operates through three thermodynamic stages. The first stage starts off with the piston at TDC at high pressure $P_M$, ambient temperature $T_S$, and a specific volume $v_T$, and thus $$v_1=v_T, \tag{26}$$

$$P_1=P_M, \tag{27}$$

$$T_1=T_S. \tag{28}$$

The first step is ideal isentropic expansion of the gas in the piston to BDC, causing a drop in pressure and temperature, and recovering mechanical energy from the expansion. By definition, at BDC the volume will increase proportional to the compression ratio, and $$v_2=\phi\cdot v_T. \tag{29}$$

As this expansion is ideal and isentropic, equation 15 can be used to find the pressure decrease, and thus $$\left(\frac{P_2}{P_1}\right)_{\Delta S=0} = \left(\frac{v_1}{v_2}\right)^k = \left(\frac{v_T}{v_T\cdot\phi}\right)^k = \left(\frac{1}{\phi}\right)^k, \tag{30}$$

and thus $$P_2 = \phi^{-k}\cdot P_M.$$

As $\phi$ is greater than 1, $P_2$ will be less than $P_1$ and $P_M$.

The same isentropic relationship can be used to find the temperature change, and thus following equation 13, $$\left(\frac{T_2}{T_1}\right)_{\Delta S=0} = \left(\frac{v_1}{v_2}\right)^{k-1} = \left(\frac{1}{\phi}\right)^{k-1}, \tag{31}$$

and thus $$T_2 = \phi^{1-k}\cdot T_S.$$

Throughout the isentropic expansion, the mechanical energy is recovered to the crankshaft (Part 9) controlling the piston (Part 2), which is connected to a motor/regenerative brake (Part 10). In an isentropic process, the mechanical energy recovered $W_{12}$ (J/kg), for a truly ideal case is (equation 17)

$$\begin{aligned} W_{12} &= u_1 - u_2, \\ &= C_V\cdot(T_2-T_1), \\ &= R\cdot\frac{1}{k-1}\cdot T_S\cdot(\phi^{1-k}-1), \end{aligned} \tag{32}$$

and thus $$W_{12} = P_M\cdot v_T\cdot\frac{(\phi^{1-k}-1)}{k-1}.$$

Equation 32 is negative, to represent mechanical work out.

It is clear from equation 31 that the isentropic expansion will result in a temperature decrease, as both $\phi>1$ and $k>1$. The second step, after the isentropic expansion, is for the cylinder to heat up at constant BDC volume ($v_3=v_2$) up to $T_S$. Under these known values of the temperature and volume, $$v_3=\phi\cdot v_T, \tag{33}$$

$$T_3=T_S. \tag{34}$$

The ideal gas law in equation 1 can be rewritten as $$\frac{P}{T} = \frac{R}{v},$$

and at a constant specific volume, $$\frac{P_3}{T_3} = \frac{P_2}{T_2},$$

and using this relationship, the newly heated pressure can be calculated as $$P_3 = T_3\frac{P_2}{T_2} = T_S\frac{\phi^{-k}\cdot P_M}{\phi^{1-k}\cdot T_S}, \tag{35}$$

and thus $$P_3 = \phi^{-1}\cdot P_M.$$

It is clear that the pressure at Stage 3 will be both greater than Stage 2 and less than the high pressure value at Stage 1, $P_2<P_3<P_M$.

The entropy to leave the ambient universe $S_{23}$ (J/kg·K) is determined by dividing the heat energy into the piston $Q_{23}$ (J/kg) by the source/sink temperature, $$S_{23} = \frac{Q_{23}}{T_S},$$

and the heat energy in $Q_{23}$ can be simply calculated as the change in temperature multiplied by the specific heat at a constant volume, where $$Q_{23} = C_V(T_3-T_2) = \frac{R}{k-1}(T_3-T_2) = \frac{R}{k-1}T_S(1-\phi^{1-k}), \tag{36}$$

and thus the entropy decrease in the ambient universe by this step $S_{23}$, $$S_{23} = \frac{R}{k-1}(1-\phi^{1-k}). \tag{37}$$

While entropy is leaving the ambient universe into the system, a greater amount of entropy $S_{23}^{in}$ (J/kg·K) is entering the gas. This amount can be determined by dividing the heat energy input by the average temperature during the heating.

$$S_{23}^{in} = \int_{T_2}^{T_3} \frac{C_V \cdot dT}{T} = \frac{R}{k-1} \cdot \int_{T_S \cdot \phi^{1-k}}^{T_S} \frac{dT}{T} = \frac{R}{k-1} \cdot \log(\phi^{k-1}), \tag{38}$$
$$= R \cdot \log(\phi),$$

and for all physically possible (greater than unity) values of $\phi$ and k, the entropy in $S_{23}^{in}$ is greater than the entropy out $S_{23}$, due to the second law of thermodynamics.

The last and final step is isothermal compression, at a consistent temperature $T_S$, back to the original pressure $P_M$ and specific volume $v_T$ in Stage 1. The piston compresses the working glass slowly, slow enough that there is sufficient time for the gas to cool back to the original temperature after a slight temperature increase from compression. The mechanical work in $W_{31}$ (J/kg), which originates from the electric motor (Part 10), can be found with equation 19, where $$W_{31} = R \cdot T_S \cdot \log\left(\frac{P_1}{P_3}\right),$$
$$= R \cdot T_S \cdot \log\left(\frac{P_M}{P_M \cdot \phi^{-1}}\right),$$

and by using the ideal gas law (equation 1), the mechanical energy input during the isothermal compression is $$W_{31} = P_M \cdot v_T \cdot \log(\phi) \tag{39}$$

During isothermal compression, the enthalpy h and internal energy u remain constant, and thus the heat energy output $Q_{31}$ (J/kg) is equal to the mechanical energy input $W_{31}$ $$Q_{31} = W_{31} = P_M \cdot v_T \cdot \log(\phi) = R \cdot T_S \cdot \log(\phi), \tag{40}$$

and thus the final entropy out to the universe can be found with equation 16

$$S_{31} = \frac{Q_{31}}{T_S}, \tag{41}$$
$$= R \cdot \log(\phi).$$

The reversible cycle is now back at the initial stage. The thermodynamic ratios for temperature, pressure, and specific volume throughout the cycle can be found in table 1.

The net mechanical work into the cycle $W_{net}$ (J/kg) is simply (equation 39) the total work in $W_{31}$ (J/kg) minus (equation 32) the mechanical work out $W_{12}$ (J/kg),

TABLE 1

Table of the pressure, temperature, and specific volume and the three different stages of the thermodynamic heat pump cycle. The temperature, pressure, and specific volume are given as a ratio of the Stage 1 TDC thermodynamic parameters, and are a function of piston compression ratio $\phi$ and specific heat ratio k.

| Stage | $T_s$ | $P_M$ | $\upsilon_T$ |
|---|---|---|---|
| 1 | 1 | 1 | 1 |
| 2 | $\phi^{1-k}$ | $\phi^k$ | $\phi$ |
| 3 | 1 | $\phi^{-1}$ | $\phi$ |

$$W_{net} = W_{31} + W_{12}, \tag{42}$$
$$= P_M \cdot v_T \cdot \log(\phi) + \frac{P_M \cdot v_T}{k-1} \cdot (\phi^{1-k} - 1),$$
$$= P_M \cdot v_T \cdot \left\{\log(\phi) + \frac{\phi^{1-k} - 1}{k-1}\right\}.$$

In a thermodynamic analysis, it is absolutely essential to make sure the cycle obeys the laws of thermodynamics. The first law dictates that (disregarding relativistic physics) energy can neither be created or destroyed. The second law dictates that a thermodynamic process must cause either no change (isentropic) or an increase in entropy throughout the universe. These laws are established by countless examples of empirical evidence, and must be regarded as absolute truths. If either of these two laws were to be violated, one would have discovered perpetual motion, and despite countless attempts, no such effort has successfully violated the laws of thermodynamics.

This cycle follows the second law of thermodynamics, in that it consistently increases the net entropy to the universe. This can be easily realized by comparing the heat energy in $Q_{23}$ (J/kg) and the heat energy out $Q_{31}$ (J/kg). The net entropy generated to the universe is directly proportional to these heat flows, as the temperature is identical at both the source and the sink. The total entropy generated to the universe from this cycle is calculated as the difference between the entropy out of the cycle $S_{31}$ (equation 41) minus the entropy in $S_{23}$ (equation 37)

$$S_{net} = S_{31} - S_{23}, \tag{43}$$
$$= R \cdot \log(\phi) - \frac{R}{k-1}(1-\phi^{1-k}),$$
$$= \frac{P_M \cdot v_T}{T_S} \cdot \left\{\log(\phi) - \frac{1}{k-1} + \frac{\phi^{1-k}}{k-1}\right\},$$

and equation 43 is mathematically positive for all values of $\phi$ and k. This is verification that this cycle is valid and does not violate the second law of thermodynamics.

In order to demonstrate that this cycle does not violate the conservation of energy and the first law of thermodynamics, an energy balance must be demonstrated. This is demonstrated by the sums of the net mechanical energy $W_{net}$ (equation 42); and the net heat energy $Q_{net}$ out, which is directly proportional (equation 16) to the net entropy $S_{net}$ (equation 43)

$$Q_{net} = T_S \cdot S_{net}, \quad (44)$$
$$= P_M \cdot v_T \cdot \left\{\log(\phi) - \frac{1}{k-1} + \frac{\phi^{1-k}}{k-1}\right\}.$$

If this cycle were physically possible, the sum of the energy sources would balance out $$W_{net} - Q_{net} = 0, \quad (45)$$

and dividing equation 45 by $P_M \cdot v_T$, the energy balance will be $$\left\{\log(\phi) + \frac{\phi^{1-k}-1}{k-1}\right\} - \left\{\log(\phi) - \frac{1}{k-1} + \frac{\phi^{1-k}}{k-1}\right\} = 0, \quad (46)$$

and equation 46 mathematically holds true for all values of $\phi$ and k.

The COP of this heat pump (equation 20 and 21) can be calculated as $$COP_{HP} = \frac{Q_{31}}{W_{net}} = \frac{P_M \cdot v_T \cdot \log(\phi)}{P_M \cdot v_T \cdot \left\{\log(\phi) + \frac{\phi^{1-k}-1}{k-1}\right\}} = \frac{\log(\phi)}{\log(\phi) + \frac{\phi^{1-k}-1}{k-1}}, \quad (47)$$

$$COP_R = \quad (48)$$
$$\frac{Q_{23}}{W_{net}} = \frac{P_M \cdot v_T \frac{1-\phi^{1-k}}{k-1}}{P_M \cdot v_T \cdot \left\{\log(\phi) + \frac{\phi^{1-k}-1}{k-1}\right\}} = \frac{1-\phi^{1-k}}{(k-1)\cdot\log(\phi) + \phi^{1-k} - 1}.$$

In this heat pump cycle, $T_2$ is the lowest temperature $T_L$ (K), and $T_S$ is the maximum temperature $T_H$ (K). By plugging in equation 31 and $T_S$ into equation 22 and 23, $$COP_{HP,c} = \left[1 - \frac{\phi^{1-k} \cdot T_S}{T_S}\right]^{-1} = [1 - \phi^{1-k}]_{-1}, \quad (49)$$

$$COP_{R,c} = \left[\frac{T_S}{\phi^{1-k} \cdot T_S} - 1\right]^{-1} = [\phi^{k-1} - 1]^{-1}. \quad (50)$$

For all physically real values of $\phi$ and k (greater than unity), the COP is greater than the Carnot maximum COP $$\frac{\log(\phi)}{\log(\phi) + \frac{\phi^{k-1}-1}{k-1}} > [1 - \phi^{1-k}]^{-1},$$

$$\frac{1-\phi^{1-k}}{(k-1)\cdot\log(\phi) + \phi^{1-k} - 1} > [\phi^{k-1} - 1]^{-1}.$$

While this heat pump has an effective COP greater than the Carnot COP for its given temperature range, it does not violate the second law of thermodynamics, as the heat input occurs throughout a large range of temperatures spanning from the coldest $T_2$ to the ambient temperature range $T_S$, and universal entropy is not decreased. With this cycle, provided a complex system of regeneration of the heating fluid is utilized, the heating fluid can be cooled down to the coldest temperature $T_2$ with greater efficiency than traditional refrigeration methods. The smaller the temperature difference between the surrounding heating source and the working gas as it undergoes isochoric cooling, the greater cooling temperatures can be reached as this cooled heating fluid is released from the cycle.

One possible modification of this cycle would be to have the isentropic expansion be a flow process with a turbine, rather than a closed boundary process with a piston and a cylinder. There would inherently be a greater work output of the turbine, as the turbine work is proportional to the change in enthalpy (equation 18), rather than internal energy as is the case in a closed system (equation 17).

$$W_{12,flow} = h_1 - h_2, \quad (51)$$
$$= C_P \cdot (T_2 - T_1),$$
$$= R \cdot \frac{k}{k-1} \cdot T_S \cdot (\phi^{1-k} - 1),$$
$$= P_M \cdot v_T \cdot \frac{k}{k-1} \cdot (\phi^{1-k} - 1).$$

The isochoric heating, however, must take place in a closed boundary. For this gas to first flow into and out of the pressure vessel, a work load equal to the product of the pressure and volume must be applied $$W_{23,flow} = (P_3 \cdot v_3) - (P_2 \cdot v_2), \quad (52)$$
$$= \left(\frac{P_M}{\phi} - \frac{P_M}{\phi^k}\right) \cdot \phi \cdot v_T,$$
$$= P_M \cdot v_T \cdot (1 - \phi^{1-k}),$$

and thus the net work output before the isothermal compression is $$W_{23,flow} = W_{12,flow} + W_{23,flow},$$
$$= P_M \cdot v_T \cdot \frac{k}{k-1} \cdot (\phi^{1-k} - 1) + P_M \cdot v_T \cdot (1 - \phi^{1-k}),$$
$$= P_M \cdot v_T \cdot (\phi^{1-k} - 1) \cdot \left(\frac{k}{k-1} - 1\right),$$
$$= P_M \cdot v_T \cdot \frac{(\phi^{1-k} - 1)}{k-1},$$
$$= W_{12},$$

where $W_{12}$ was previous defined in equation 32. For the isothermal compression, the work input is the same whether it occurs in a flow process or a closed-boundary process (equation 19). As a result, having the working gas expand isentropically in a turbine versus a piston has no thermodynamic impact to the system COP.

This cycle can easily be modified into a practical heat pump with a high-temperature heat output. Rather than compressing the gas slowly so the compression is isothermal, the gas can be compressed back to the original TDC volume $v_T$ rapidly, consuming more mechanical energy input but generating a temperature increase, which can be cooled at a constant volume (isochoric) back to the initial Stage 1.

If the piston were to, from Stage 3, rapidly compress the gas back to TDC $$v_4 = v_T, \quad (53)$$

the pressure $P_4$ can be calculated with equation 15

$$\left(\frac{P_4}{P_3}\right)=\left(\frac{v_3}{v_4}\right)^k=\left(\frac{P_4}{P_M\cdot\phi^{-1}}\right)=\left(\frac{v_T\cdot\phi}{v_T}\right)^k,$$

which leads to $$P_4=P_M\cdot\phi^{k-1}. \tag{54}$$

The temperature $T_4$ can be calculated with equation 13

$$\left(\frac{T_4}{T_3}\right)=\left(\frac{v_3}{v_4}\right)^{k-1}=\left(\frac{T_4}{T_M}\right)=\left(\frac{v_T\cdot\phi}{v_T}\right)^{k-1},$$

which leads to $$T_4=T_S\cdot\phi^{k-1}. \tag{55}$$

By adding the additional isentropic compression, the temperature and work output will increase, as well as the work input $W_{34}$ (J/kg), which can be found with equation 8 and 17, $$W_{34}=C_V\cdot(T_4-T_3), \tag{56}$$

$$=P_M\cdot v_T\cdot\frac{\phi^{k-1}-1}{k-1}.$$

Finally, the cylinder can remain at TDC and cool at a constant volume until the working gas is back to Stage 1. The heat output $Q_{41}$ (J/kg) is $$Q_{41}=C_V\cdot(T_4-T_1), \tag{57}$$

$$=P_M\cdot v_T\cdot\frac{\phi^{k-1}-1}{k-1}.$$

The internally reversible cycle is now back at the initial stage. The thermodynamic ratios for temperature, pressure, and specific volume throughout the cycle can be found in table 2.

TABLE 2

Table of the thermodynamic stages of the high-temperature heat pump cycle. The temperature, pressure, and specific volume are given as a ratio of the Stage 1 TDC thermodynamic parameters, and are a function of piston compression ratio $\phi$ and specific heat ratio k.

| Stage | $T_s$ | $P_M$ | $v_T$ |
|---|---|---|---|
| 1 | 1 | 1 | 1 |
| 2 | $\phi^{1-k}$ | $\phi^{-k}$ | $\phi$ |
| 3 | 1 | $\phi^{-1}$ | $\phi$ |
| 4 | $\phi^{k-1}$ | $\phi^{k-1}$ | 1 |

When comparing this heat pump cycle, it is clear that the net total work input $W_{net}^*$ (J/kg)

$$W_{net}^*=P_M\cdot v_T\cdot\frac{\phi^{k-1}+\phi^{1-k}-2}{k-1}. \tag{58}$$

The COP (equation 20 and 21) can be found by taking the quotient of both $Q_{41}$ and $W_{net}^*$, as well as the quotient of $Q_{23}$ and $W_{net}^*$, $$COP_{HP}^*=\frac{Q_{41}}{W_{net}^*}=\frac{\phi^{k-1}-1}{\phi^{k-1}+\phi^{1-k}-2}, \tag{59}$$

$$COP_R^*=\frac{Q_{23}}{W_{net}^*}=\frac{1-\phi^{1-k}}{\phi^{k-1}+\phi^{1-k}-2}. \tag{60}$$

In this heat pump cycle, $T_2$ is the lowest temperature $T_L$ (K), and $T_4$ is the maximum temperature $T_H$ (K). By plugging in equation 31 and 55 into equation 22, $$COP_{HP,c}^*=\left[1-\frac{\phi^{1-k}\cdot T_S}{\phi^{k-1}\cdot T_S}\right]^{-1}=[1-\phi^{2\cdot(1-k)}]^{-1}. \tag{61}$$

$$COP_{R,c}^*=\left[\frac{\phi^{k-1}\cdot T_S}{\phi^{1-k}\cdot T_S}-1\right]^{-1}=[\phi^{2\cdot(k-1)}-1]^{-1}. \tag{62}$$

For all physically possible values of $\phi$ and k (greater than unity), the value of $COP^*_{HP}$ and $COP^*_R$ is greater than the Carnot-defined value of $COP^*_{HP,c}$ and $COP^*_{R,c}$ $$\frac{\phi^{k-1}-1}{\phi^{k-1}+\phi^{1-k}-2}>[1-\phi^{2\cdot(1-k)}]^{-1},$$

$$\frac{1-\phi^{1-k}}{\phi^{k-1}+\phi^{1-k}-2}>[\phi^{2\cdot(k-1)}-1]^{-1}.$$

There are infinite variations of this heat pump cycle in between the slow isothermal compression and the rapid isentropic compression that can be utilized with the same physical heat pump apparatus by changing the motor speed. For example, the gas can be compressed back to the original pressure $P_M$ rapidly, followed by cooling at a constant pressure (isobaric) back to the initial Stage 1. The pressure at this stage is thus $$P'_4=P_M. \tag{63}$$

Equation 15 can be rewritten as $$\left(\frac{v'_4}{v_3}\right)_{\Delta S=0}=\left(\frac{P'_4}{P_3}\right)^{-\frac{1}{k}},$$

and thus the volume after isentropic compression is $$v'_4=v_3\cdot\left(\frac{P_M}{P_M\cdot\phi^{-1}}\right)^{-\frac{1}{k}}=(v_T\cdot\phi)\cdot\left(\phi^{-\frac{1}{k}}\right),$$

which simplifies to $$v'_4=v_T\cdot\phi^{\frac{k-1}{k}}. \tag{64}$$

The isentropic temperature increase can be calculated with equation 14, $$\left(\frac{T_4'}{T_3}\right)_{\Delta S=0} = \left(\frac{P_4'}{P_3}\right)^{\frac{k-1}{k}} = \left(\frac{P_M}{P_M \cdot \phi^{-1}}\right)^{\frac{k-1}{k}} = \phi^{\frac{k-1}{k}},$$

and thus the hot gas after isentropic compression is $$T_4' = T_S \cdot \phi^{\frac{k-1}{k}}. \tag{65}$$

The last and final process is isobaric cooling back to the original Stage 1 pressure and volume. The internally reversible cycle is now back at the initial stage. The thermodynamic ratios for temperature, pressure, and specific volume throughout the cycle can be found in table 3.

TABLE 3

| Stage | $T_s$ | $P_M$ | $v_T$ |
|---|---|---|---|
| 1 | 1 | 1 | 1 |
| 2 | $\phi^{1-k}$ | $\phi^{-k}$ | $\phi$ |
| 3 | 1 | $\phi^{-1}$ | $\phi$ |
| 4 | $\phi^{\frac{k-1}{k}}$ | 1 | $\phi^{\frac{k-1}{k}}$ |

Table of the thermodynamic stages of the medium-temperature heat pump cycle. The temperature, pressure, and specific volume are given as a ratio of the Stage 1 TDC thermodynamic parameters, and are a function of piston compression ratio $\phi$ and specific heat ratio k.

In these heat pump examples, as the temperature at Stage 3 is equal to the $T_S$ temperature at Stage 1, the internal energy and enthalpy at Stage 3 is equal to the internal energy and enthalpy at Stage 1; as a result, the mechanical work input of compression is equal to the heat energy output of the heat pump. This is the case for the isothermal compression example, as well as the full isentropic expansion example. In this particular example, the mechanical work input $W'_{34}$ (J/kg) as well as the heat energy output $Q''_{41}$ (J/kg) is $$\begin{aligned} Q_{41}' &= C_P \cdot (T_4' - T_1), \\ &= R \cdot T_S \cdot \frac{k}{k-1} \cdot \left(\phi^{\frac{k-1}{k}} - 1\right), \\ &= W_{34}'. \end{aligned} \tag{66}$$

and for all values of $\phi$ and k greater than unity, $W'_{34}$ and $Q'_{41}$ is greater than the compression work input $W_{31}$ and heat output $Q_{31}$ of the isothermal cycle, and less than the compression work input $W_{34}$ and heat output $Q_{41}$ of the rapid isentropic expansion example, $$P_M \cdot v_T \cdot \frac{\phi^{k-1} - 1}{k-1} > P_M \cdot v_T \cdot \frac{k}{k-1} \cdot \left(\phi^{\frac{k-1}{k}} - 1\right) > P_M \cdot v_T \cdot \log(\phi).$$

This version is one of infinite variable settings that this heat pump cycle can be set to by adjusting the compressor motor speed, to provide a greater heat output with this heat pump cycle.

The description thus far has been a theoretical model, which can be demonstrated in an engineering design example in order to practically implement this heat pump that the inventor claims. There are countless variations of the theoretical heat pump cycle, but this example to be discussed will consist of a cylinder and piston with a bore b of 7 cm, a stroke s of 10 cm, a compression ratio $\phi$ of 2, and an initial TDC starting pressure of 2 MPa. The compression ratio is set by the crank length l (Part 6)

$$l = \frac{1}{2} \cdot \left(s - \frac{s}{\phi}\right), \tag{67}$$

and so for a compression ratio $\phi$ of 2, the crank length is 2.5 cm.

The working fluid used in this design is helium. Helium is a superior working gas, due to the fact that it has a higher specific heat ratio k due to it being a monatomic molecule. The higher specific heat ratio results in a colder temperature after isentropic expansion $T_2$, as well as a higher mechanical work output $W_{12}$.

The other design parameter discussed in the example is the ambient fluids, which for the sake of simplicity will be standard air. This analysis will look at both forced and natural convection on the smooth cylinder; the ambient air will be flowing at 5 meters/s, and at a temperature of 25° C. A good rate of heat transfer will make the compression effectively be isothermal.

Another design parameter will be the speed of the isothermal compression. For the sake of mechanical simplicity, the isochoric heating (Stage 2-3) and the isothermal compression (Stage 3-1) will be merged into one; the compression will start as soon as the isentropic expansion is complete. The slower the isothermal compression, the more efficient the cycle will be; but with a longer cycle time, the overall heat pump cooling load output will be reduced. For this design example, a compression time of 0.1 seconds will be used; this can be achieved with a motor speed of 300 RPM.

One design consideration is controlling the flow of ambient air to a hot and cold side. The goal of a heat pump is to separate hot and cold, and therefore the flow of ambient air during compression is redirected once the ambient temperature of 25° C. has been reached. At the initial moments of compression, the air will cool significantly from the ambient temperature, the final output of the heat pump. After ambient temperature has been reached, the air flowing will experience a slight temperature increase as the compression is isothermal. In this design example, the cutoff shall occur after 0.02 seconds of compression, or 36° up from BDC.

In order to accurately model the heat pump, one determines the pressure and tem—perature as the cylinder compresses slowly to avoid exceeding the ambient temperature. The value of the rate of heat transfer $\overline{Q}$ (J) due to convection from the ambient fluid is $$\overline{Q} = h \cdot A \cdot \delta T \cdot \Delta t_{conv}, \tag{68}$$

where h ($W/m^2 \cdot K$) is the convection coefficient, A ($m^2$) is the surface area of the cylinder, $\Delta t_{conv}$ (s) is the time of heat transfer, and $\delta T$ (K) is the temperature difference. The convection coefficient h can be found with the dimensionless Nusselt number Nu $$Nu = \frac{h \cdot L_C}{\kappa_{amb}}, \tag{69}$$

where $\kappa_{amb}$ (W/m·K) is the thermal conductivity of the ambient fluid, and $L_C$ (m) by definition is the characteristic length, which in this case is the stroke of the cylinder. For natural convection, the Nusselt number is a function of the dimensionless Rayleigh number Ra, $$Ra = \frac{g \cdot \beta \cdot \delta T \cdot Pr_{amb} \cdot L_c^3}{v^2} \tag{70}$$

where g (9.81 m/s$^2$) is the gravitation acceleration, v (m$^2$/s) is the kinematic viscosity, $Pr_{amb}$ is the dimensionless Prandtl number of the ambient fluid, and β (K$^{-1}$) is the inverse of the average temperature. The Rayleigh number defined in equation 70 can be used in an empirical equation to find the Nusselt number for natural convection $$Nu_{natural} = \left\{(0.825 + 0.387 \cdot Ra^{\frac{1}{6}}) \cdot \left(1 + \left(\frac{0.492}{Pr_{amb}}\right)^{\frac{9}{16}}\right)^{-\frac{8}{27}}\right\}^2. \tag{71}$$

The next step is to determine the heat transfer as a result of the forced convection. To determine the Nusselt number for forced convection, one first finds the dimensionless Reynolds number $$Re = \frac{V \cdot D}{v}, \tag{72}$$

where D (m) is the external diameter of the cylinder $$D = b + 2 \cdot t, \tag{73}$$

t (m) is the thickness of the cylinder wall, and V (m/s) is the velocity of the forced air. The Reynolds number can be used in another empirical equation to find the Nusselt number for forced convection $$Nu_{forced} = 0.3 + [0.62 \cdot Re^{\frac{1}{2}} \cdot Pr^{\frac{1}{3}}] \cdot \left[1 + \left(\frac{0.4}{Pr}\right)^{\frac{2}{3}}\right]^{-\frac{1}{4}} \cdot \left[1 + \left(\frac{Re}{28200}\right)^{\frac{5}{8}}\right]^{\frac{4}{5}}, \tag{74}$$

and the combined final Nusselt number for both forced and natural convection is $$Nu = (Nu_{natural}^3 + Nu_{forced}^3)^{\frac{1}{3}}. \tag{75}$$

By using equations 68-75, the heat transfer coefficient h can be determined.

The calculated heat transfer coefficient alone will not give a true rate of heat transfer into the gas, as even a conductive metal as the cylinder wall material will cause some resistance to the heat transfer. An equivalent heat transfer to the gas can be found by first calculating the net thermal resistance $R_T$ (° C./W)

$$R_T = \frac{\log_N\left(\frac{D}{b}\right)}{2\pi L_c k_{cyl}} + \frac{1}{h \cdot A}, \tag{76}$$

where $k_{cyl}$ (W/° C.) is the thermal conductivity of the cylinder material. An equivalent, final heat transfer coefficient $h_{net}$ (W/m$^2$·K) can now be found $$h_{net} = \frac{1}{R_T \cdot A}. \tag{77}$$

In the design example, this 385-cc single-cylinder heat pump can achieve a net cooling load of 905 watts at a low temperature of −85° C., a full 110° C. difference from the high ambient temperature. This cooling is achieved with an ideal mechanical power input of 229 watts; assuming the compression and expansion recovery are both 95% efficient due to irreversible friction, the mechanical work input is 351 watts. This leads to an ideal $COP_R$ of 3.952, and a realistic $COP_R$ of 2.5809, both significantly higher than the Carnot $COP_R$ of 1.7024 calculated by the temperature difference; the second law of thermodynamics is not violated!

Example Parameters
Bore=7 cm
Stroke=10 cm
Cylinder Thickness=5 mm
Cylinder Thermal Conductivity=79.5 W/m·° C.
Compression Ratio=2
Crank Length=2.5 cm
Ambient Fluid=Air
Ambient Fluid Flow Speed=5 m/s
Prandtl (Ambient)=0.7296
Thermal Conductivity (Ambient)=0.02551 W/m·° C.
Density (Ambient)=1.184 kg/m$^3$
Kinematic Viscosity (Ambient)=15.62 cSt
Thermal Diffusivity (Ambient)=4.1514 mm$^2$/s
Internal Gas=Helium
Specific Heat Ratio (k)=1.6667
Specifc Heat at Constant Pressure (Cp)=5190 J/kg.° C.
Mass of Internal Gas=0.62176 g
Max Pressure=2000 kPa
Ambient Temperature=25° C.
Initial Specific Volume=0.30948 m$^3$/kg
Temperature Stage 2=−85.3273° C.
Pressure Stage 2=629.9605 kPa
Pressure Stage 3=1000 kPa
Specific entropy (ds3)=1413.9029 J/kg.° C.
Energy Input (ideal) per Cycle=259.4195 J
Energy Output (ideal) per Cycle=213.6118 J
Net Energy Input (ideal) per Cycle=45.8077 J
Design Motor Speed=300 RPM
Efficiency of Expansion=95%
Efficiency of Compression=95%
Average Real Power Input=350.7095 W
Average Ideal Power Input=229.0383 W
Cooling Load (Ideal)=905.153 W
Isothermal Heating Load (Ideal)=1134.1657 W
Displacement=0.38485 liters
Ideal $COP_{HP}$=4.9519
Ideal $COP_R$=3.952
Real $COP_{HP}$=3.2339
Real $COP_R$=2.5809
Carnot $COP_{HP}$=2.7024
Carnot $COP_R$=1.7024

HEAT PUMP COMPONENTS

Figure 1:
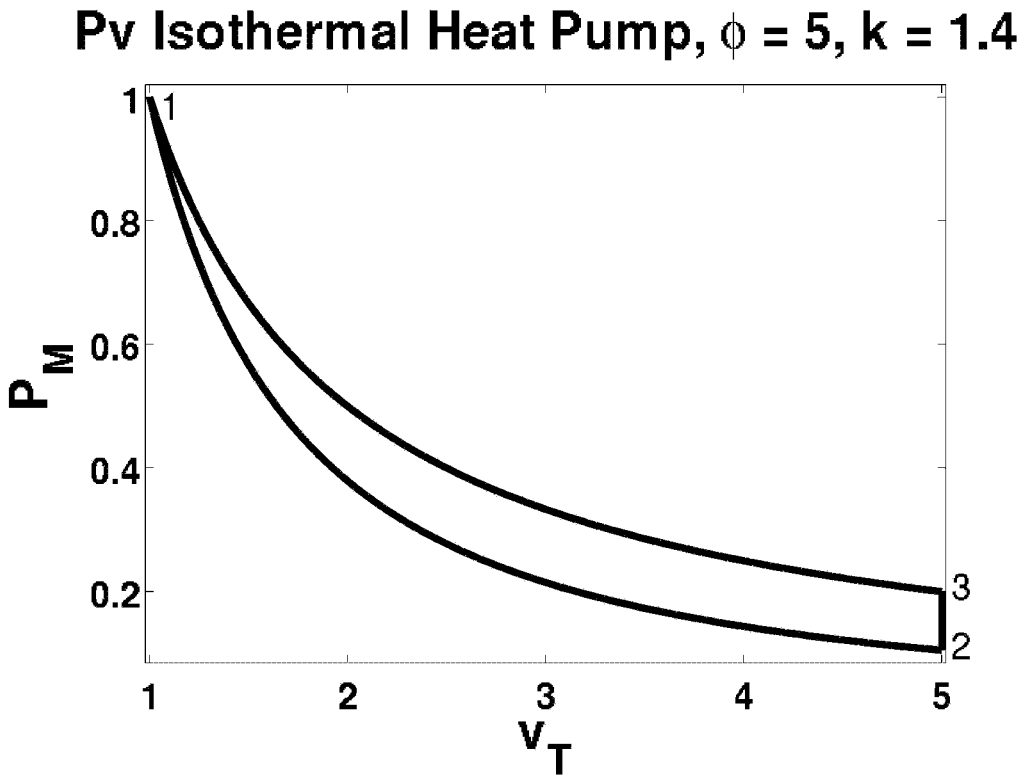
FIG. 1 Pressure-Volume diagram for an isothermal heat pump, for ϕ=5 and k=1.4.
Figure 2:
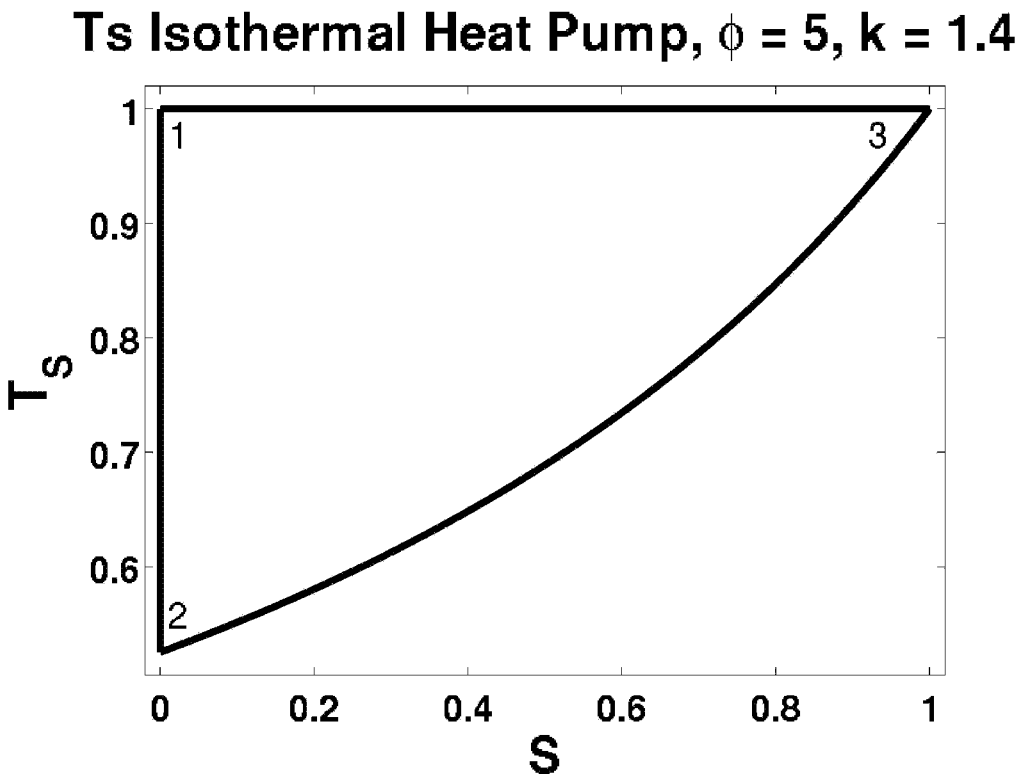
FIG. 2 Temperature-entropy diagram for the isothermal heat pump, for ϕ=5 and k=1.4. The unit value of S in this figure represents the net specific entropy change $S_{23}^{in}$ (J/kg·K) defined in equation 38.
Figure 3:
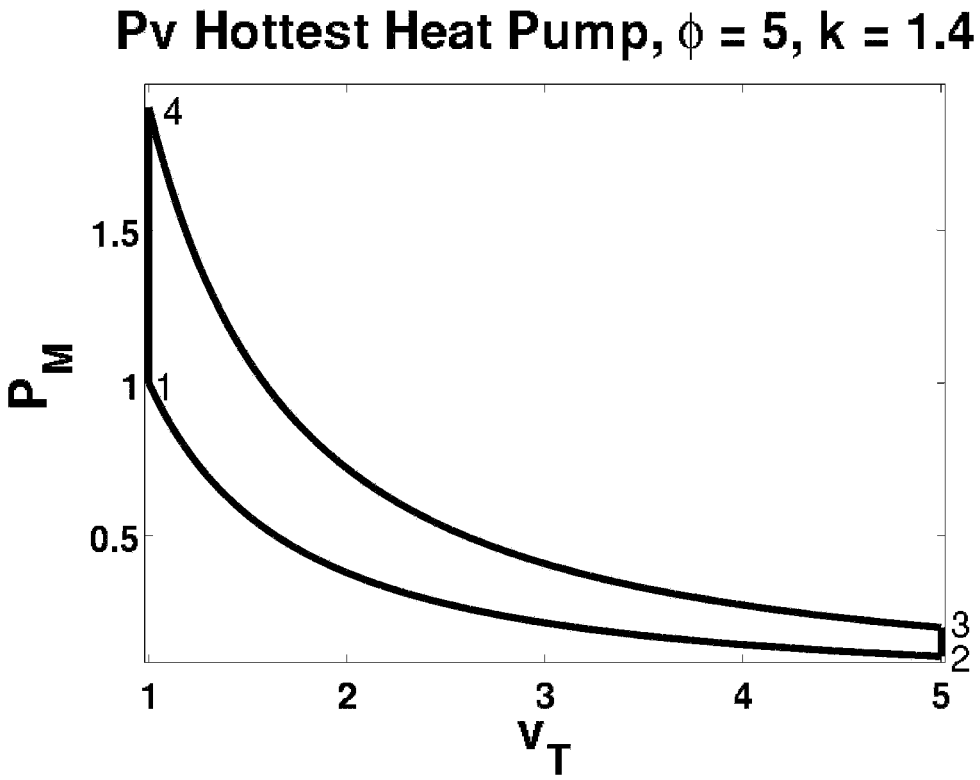
FIG. 3 Pressure-Volume diagram for a high-temperature heat pump, for $\phi=5$ and $k=1.4$.
Figure 4:
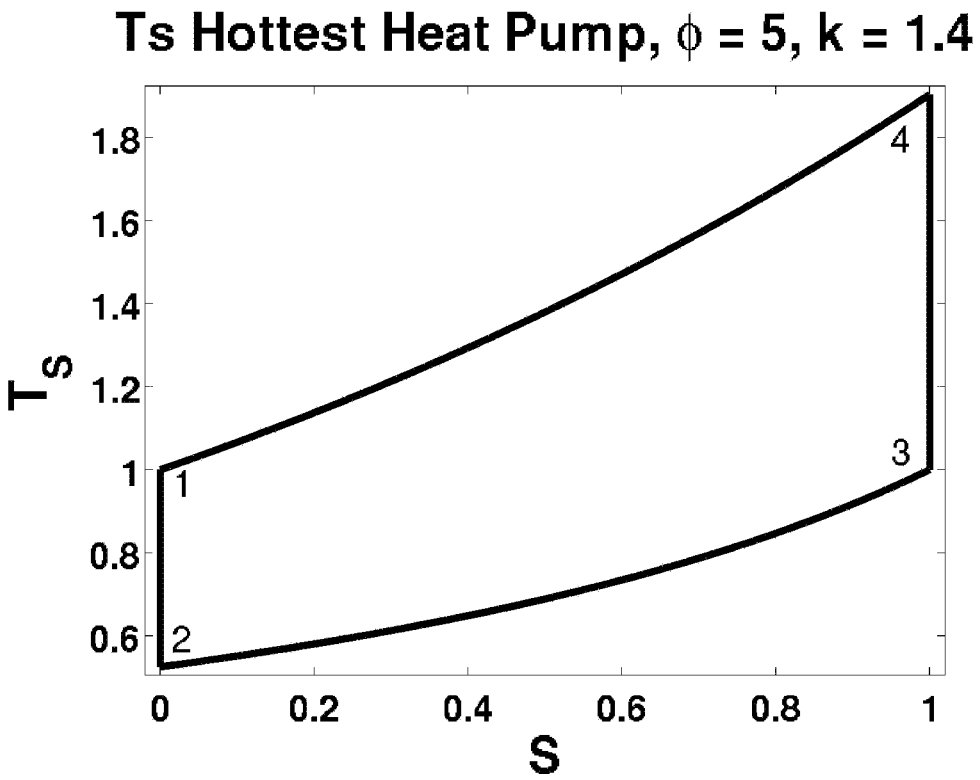
FIG. 4 Temperature-entropy diagram for the high-temperature heat pump, for $\phi=5$ and $k=1.4$. The unit value of S in this figure represents the net specific entropy change $S_{23}^{in}$ (J/kg·K) defined in equation 38.
Figure 5:
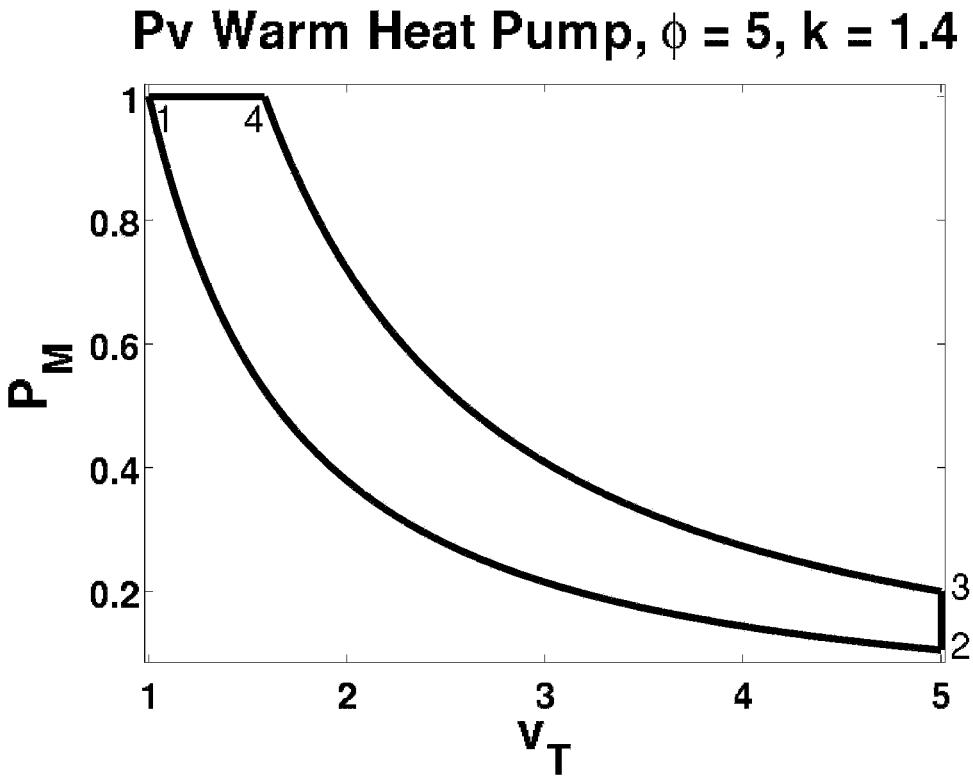
FIG. 5 Pressure-Volume diagram for a moderate-temperature heat pump, for $\phi=5$ and $k=1.4$.
Figure 6:
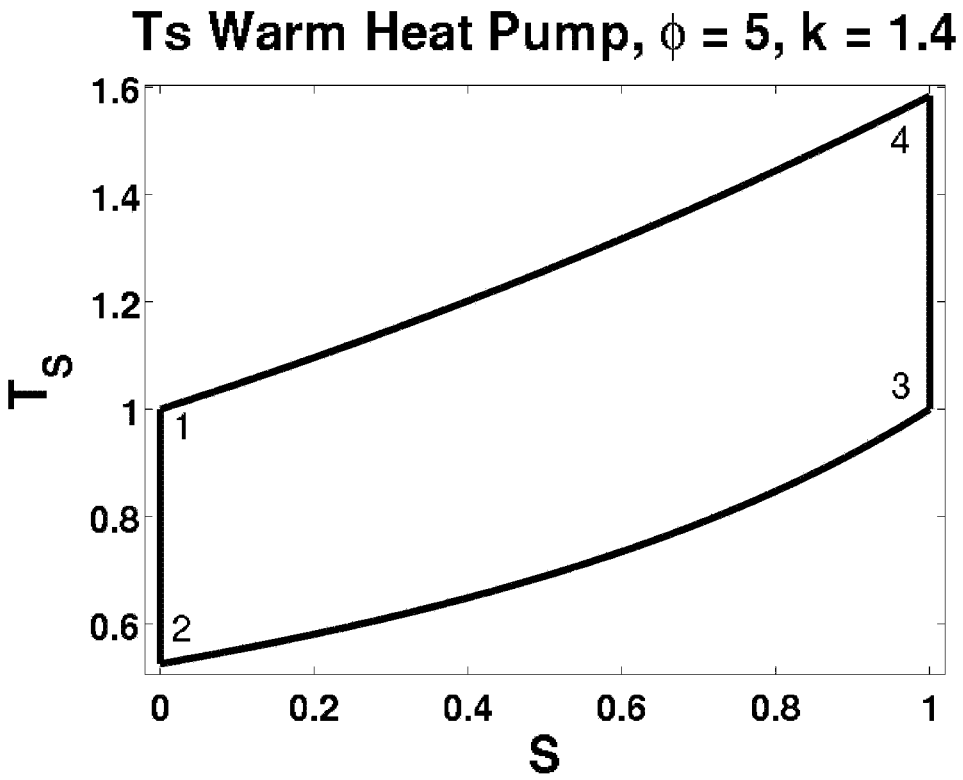
FIG. 6 Temperature-entropy diagram for the moderate-temperature heat pump, for $\phi=5$ and $k=1.4$. The unit value of S in this figure represents the net specific entropy change $S_{23}^{in}$ (J/kg·K) defined in equation 38.
Figure 7:
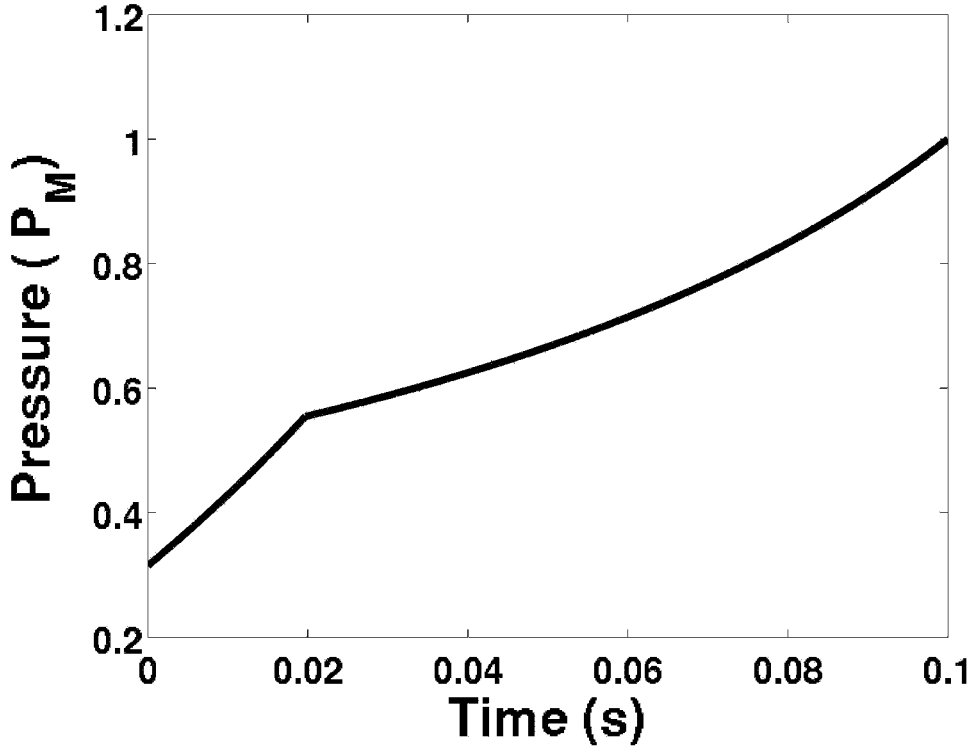
FIG. 7 Normalized Pressure Data for the isothermal heat pump cycle example.
Figure 8:
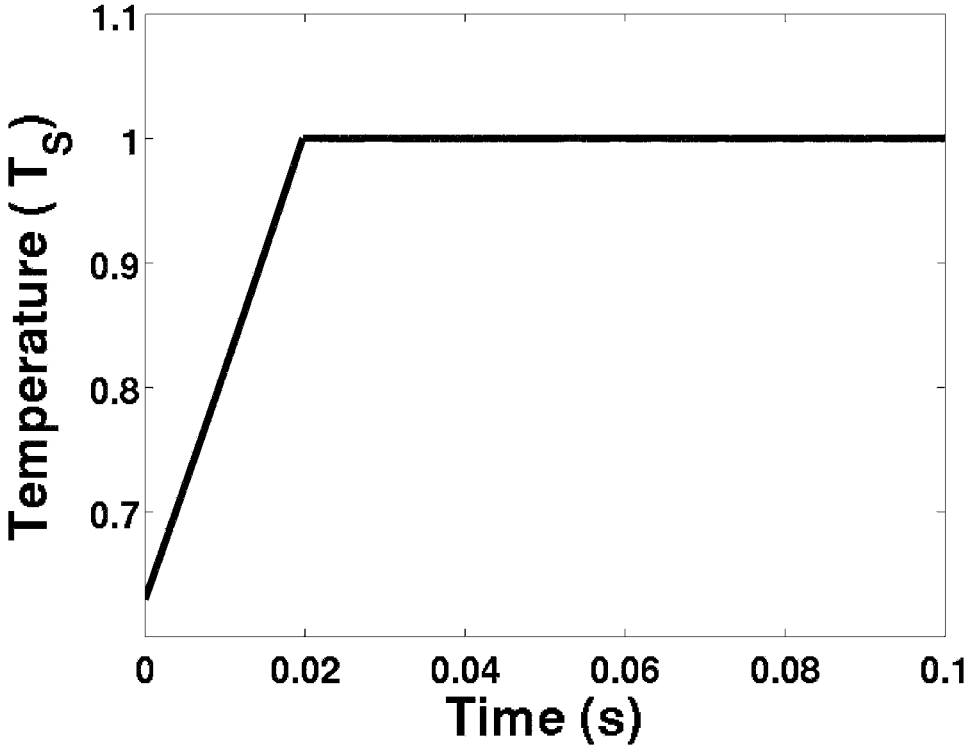
FIG. 8 Normalized Temperature Data for the isothermal heat pump cycle example.
Figure 9:
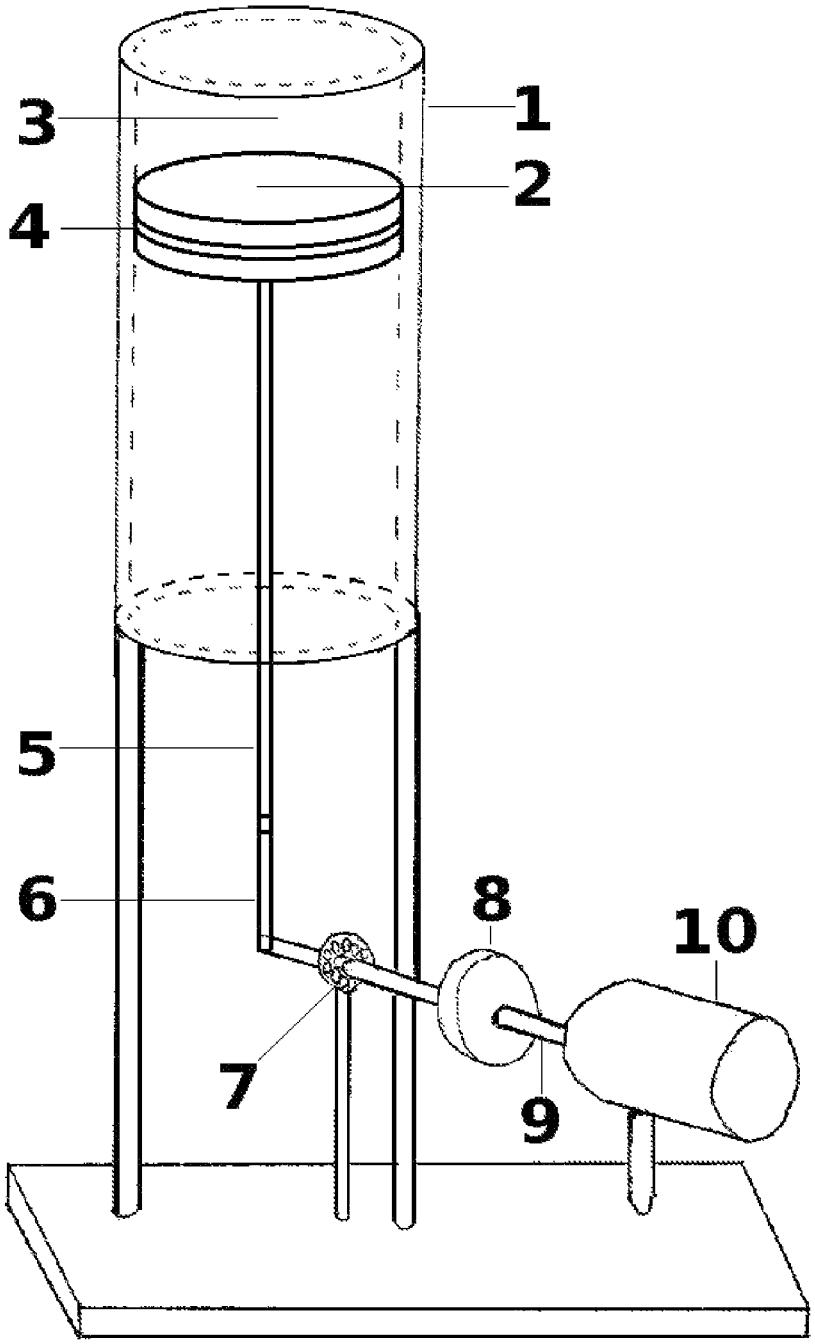
FIG. 9 Heat pump at TDC, Thermodynamic Stage 1.
Figure 10:
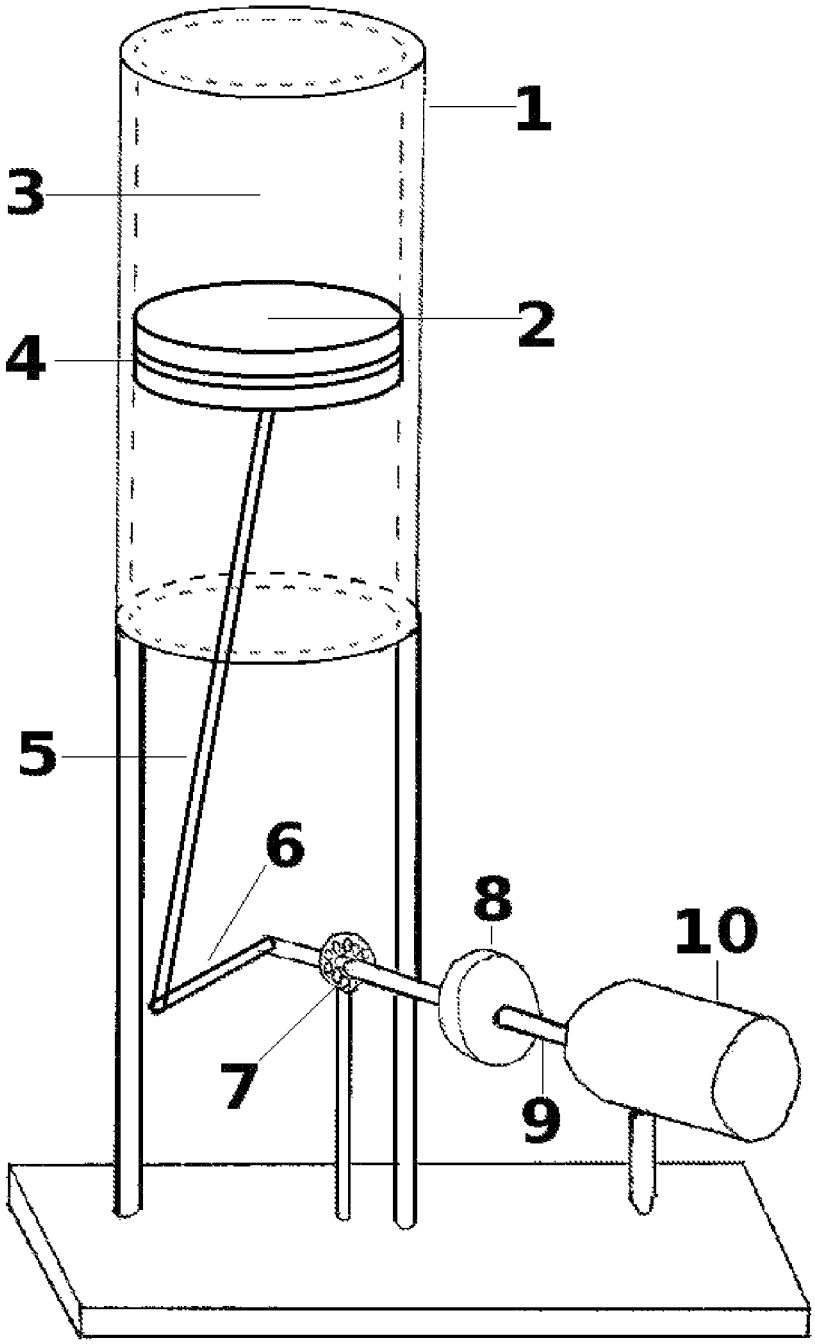
FIG. 10 Piston in descent, with isentropic expansion, moving from thermodynamic Stage 1 to Stage 2. The electric power load for the electric motor is switched off, and thus the motor works as a regenerative brake, absorbing the mechanical energy of expansion.
Figure 11:
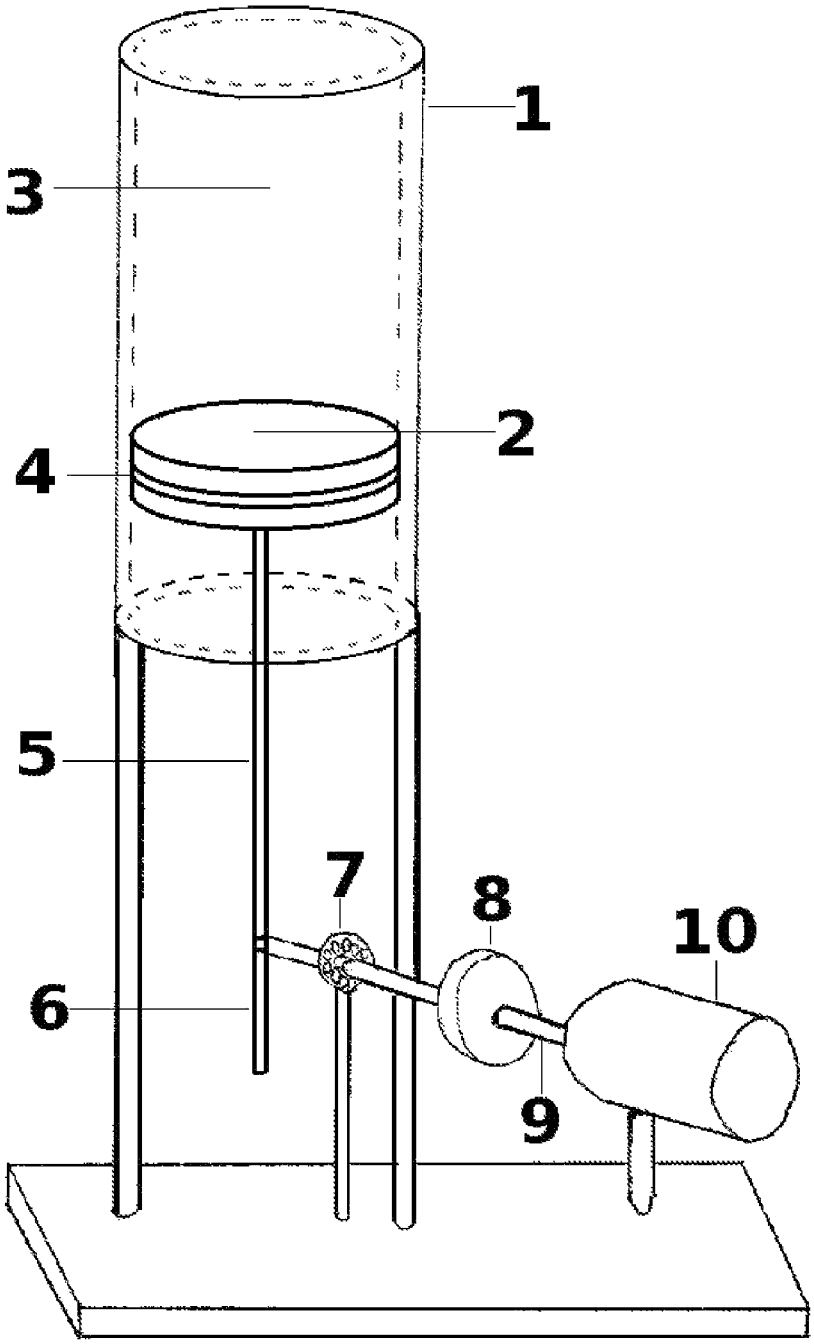
FIG. 11 Heat pump at BDC, and it initially is at Thermodynamic Stage 2. In this position, the working gas heats up at a constant volume back to the ambient temperature $T_S$, and then the heat pump is at Thermodynamic Stage 3.
Figure 12:
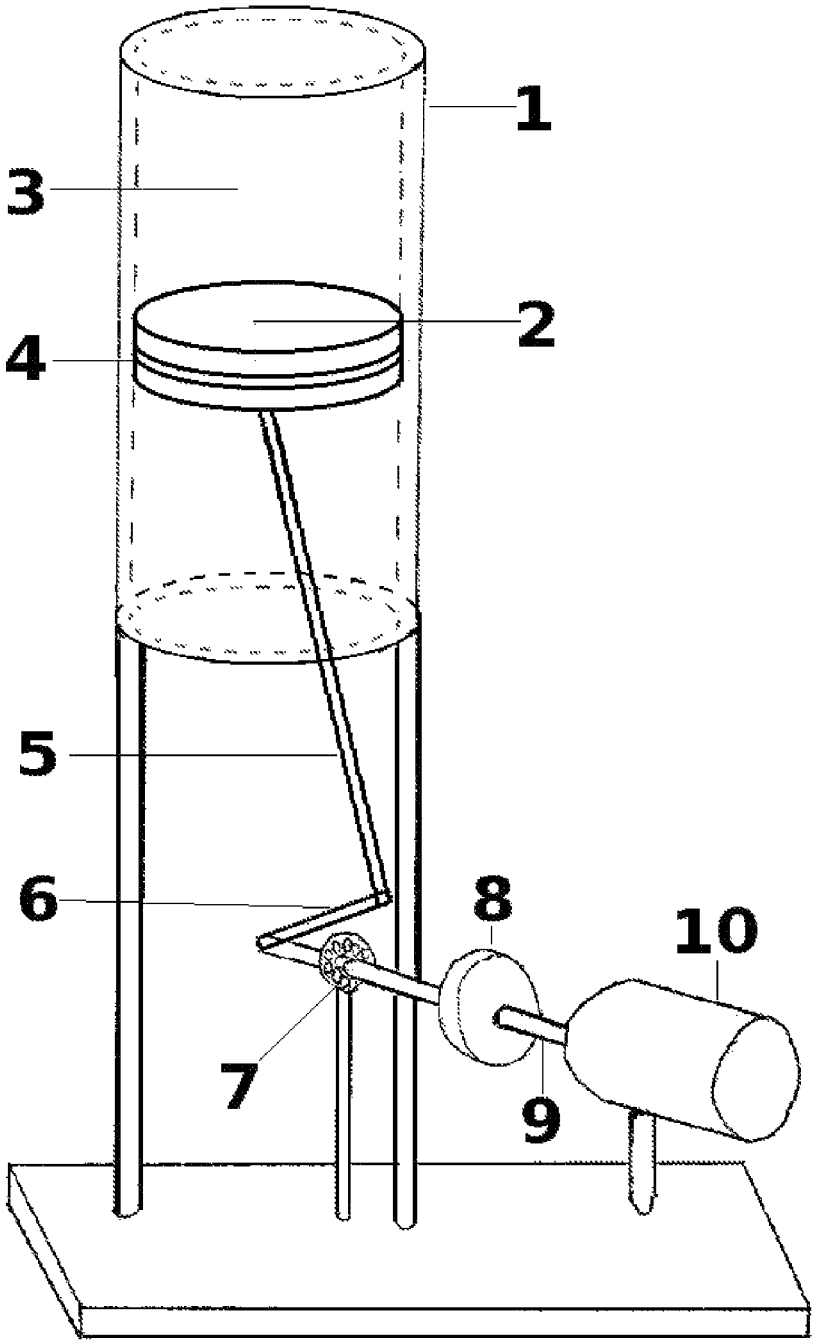
FIG. 12 Piston in ascent, and the working gas undergoes isothermal compression at a constant temperature of $T_S$. The mechanical work of compression comes from the crankshaft, and simultaneously the equivalent thermal heat escapes the cylinder to the ambient surrounding.

List of labeled components in FIG. 9-12:

1. Cylinder, of a builder-selected bore and stroke. The cylinder is sealed at the top end, and open at the bottom end. The material has a high Young's modulus, as well as be thermally conductive.
2. Piston, which will be used to both compress the gas isothermally as well as recover mechanical energy from isentropic expansion.
3. Working fluid, an ideal gas with a specific heat ratio of k.
4. Piston seal, which can ensure the working gas remains in the cylinder and has no leaks. The seal is designed to have minimal friction both during rapid isentropic expansion and as well as extremely slow isothermal compression.
5. Piston connecting rod, and is long relative to Part 6 in order to ensure minimal angular or torsional forces at different shaft positions.
6. The crankshaft connecting rod.
7. The rotating ball bearing to hold the shafts in position.
8. The flywheel.
9. The crankshaft.
10. The powered electric motor, that can also serve as a regenerative brake to recover the mechanical energy output from the isentropic expansion.

What I claim is:

1. A method of operating a mechanical heat pump, actuated by an externally powered electric motor, according to an internally reversible, thermodynamic cycle, comprising:

providing a high pressure, ambient temperature gas in a piston-cylinder system at top dead center;

isentropically expanding the high pressure, ambient temperature gas in the piston cylinder system to bottom dead center;

isochorically heating the gas in the piston cylinder system back to the ambient temperature; and isothermally compressing the gas in the piston cylinder system back to the initial state of the piston at top dead center at the ambient temperature using the externally powered electric motor via a crankshaft.

2. The method of claim 1, wherein the mechanical heat pump utilizes ambient air at a temperature cooler than the hot stage, and warmer than the cold stages disposed proximate the piston cylinder system;

after the process of isentropic expansion, this will provide a heat source for the process of isochoric heating;

followed by providing as a sink for cooling for the process of isothermal compression.

3. A mechanical heat pump as described in claim 1 with a bore of 7 cm, a stroke of 10 cm, a compression ratio of 2 and an iron cylinder wall of 5 mm thickness.

4. The mechanical heat pump of claim 3, wherein the isochoric heating and the isothermal compression are one continuous process such that the piston cylinder system begins to compress the gas at a rate slow enough that the gas reaches the ambient temperature prior to the piston cylinder system returning to top dead center.

5. The mechanical heat pump of claim 3, wherein the gas is monatomic, with a specific heat ratio of 5/3, in order to achieve both the greatest temperature difference and the greatest isentropic expansion output, for a given compression ratio.

6. The mechanical heat pump of claim 3, further comprising redirecting the flow of an ambient fluid output once the temperature of the gas reaches the ambient temperature:

when the ambient fluid acts as a source of cooling instead of a source of heat;

0.02 seconds after the piston is 36° above bottom dead center, when operating at 300 RPM.

7. A method of operating a heat pump, actuated by an externally powered electric motor, comprising:

moving a piston provided with a piston cylinder system from a top dead center position to a bottom dead center position, resulting in isentropic expansion of a high pressure, ambient temperature gas in the piston-cylinder system;

isochorically heating the gas, while the piston is at the bottom dead center position back to the ambient temperature;

moving the piston provided with the piston cylinder system from the bottom dead center position to the top dead center position to isentropically compress the gas using the externally powered electric motor via a crankshaft; and isochorically cooling the gas back to the ambient temperature at the top dead center position.

8. The method of claim 7, wherein the mechanical heat pump utilizes ambient air at a temperature cooler than the hot stage, and warmer than the cold stages disposed proximate the piston cylinder system;

after the process of isentropic expansion, this will provide a heat source for the process of isochoric heating; and after the process of isentropic compression, this will provide a heat sink for the process of isochoric cooling.

9. A method of operating a heat pump, actuated by an externally powered electric motor, comprising:

where high pressure, ambient temperature gas in a piston-cylinder system at top dead center undergoes isentropic expansion to recover mechanical energy to bottom dead center;

followed by isochoric heating back to the ambient temperature;

followed by isentropic compression back to the original pressure with a mechanical work input by the externally powered electric motor via a crankshaft; and followed by isobaric cooling back to top dead center and the initial stage of the heat pump cycle.

* * * * *